US007257918B2

(12) United States Patent
Moore

(10) Patent No.: US 7,257,918 B2
(45) Date of Patent: Aug. 21, 2007

(54) DOUBLE ACTION, HAMMER TRIGGER MECHANISM FOR A FIREARM

(76) Inventor: Wildey J. Moore, 45 Angevine Rd., Warren, CT (US) 06794

( * ) Notice: Subject to any disclaimer, the term of this patent is extended or adjusted under 35 U.S.C. 154(b) by 326 days.

(21) Appl. No.: 10/527,859

(22) PCT Filed: Sep. 26, 2003

(86) PCT No.: PCT/US03/30290

§ 371 (c)(1),
(2), (4) Date: Mar. 15, 2005

(87) PCT Pub. No.: WO2004/033983

PCT Pub. Date: Apr. 22, 2004

(65) Prior Publication Data

US 2006/0086030 A1 Apr. 27, 2006

Related U.S. Application Data

(60) Provisional application No. 60/416,030, filed on Oct. 3, 2002.

(51) Int. Cl.
*F41A 3/00* (2006.01)

(52) U.S. Cl. ..... 42/69.03; 89/147

(58) Field of Classification Search .... 42/69.01–69.03; 89/147

See application file for complete search history.

(56) References Cited

U.S. PATENT DOCUMENTS 3,722,358 A 3/1973 Seecamp
4,275,640 A 6/1981 Wilhelm
4,428,138 A 1/1984 Seecamp
5,216,195 A 6/1993 Tuma
5,386,659 A 2/1995 Vaid et al.
5,400,537 A 3/1995 Meller et al.
5,426,880 A 6/1995 Ruger et al.
6,457,271 B1 10/2002 Vaid et al.
2001/0042332 A1 11/2001 Gering et al.

FOREIGN PATENT DOCUMENTS

EP 0 550 238 A1 7/1993

*Primary Examiner*—Michelle Clement
(74) *Attorney, Agent, or Firm*—McCormick, Paulding & Huber LLP

(57) ABSTRACT

Double action, hammer trigger mechanism for a semi-automatic firearm (10) with a spring loaded slide (12) having a cam surface (28), a pivoting sear (46) to hold the hammer (20) in a cocked position and a transfer bar (26) connected to a pivot pin (54) on the trigger (24). The transfer bar has a cam finger (30) to move the transfer bar down when the slide moves in a rearward direction during firing. When the sear is holding the hammer cocked, a second finger (62) on the transfer bar is arranged to engage a single action let-off pin (56) on the sear and pivot the sear when the trigger is pulled so as to release the hammer. The cam finger also moves the transfer bar down when the slide is stationary and the trigger is operated. The transfer bar has a notch (60) receiving a double action let-off pin (58) on the hammer to cause the transfer bar to pivot the hammer in a cocking direction as the trigger is pulled. This motion moves the transfer bar notch away from the double action let-off pin to release the hammer when the trigger is pulled to a double action let-off position before the hammer reaches the cocked position.

5 Claims, 4 Drawing Sheets

DOUBLE ACTION, HAMMER TRIGGER MECHANISM FOR A FIREARM

CROSS REFERENCE TO RELATED APPLICATIONS

This application claims the benefits of prior filed, U.S. provisional patent application Ser. No. 60/416,030, now abandoned filed on Oct. 3, 2002 and International Application No. PCT/US2003/030290 filed on Sep. 26, 2003.

TECHNICAL FIELD

This invention relates to an improved double action, hammer trigger mechanism for a firearm. More particularly, it relates to an improved mechanism for releasing the hammer when the trigger operates a known type of transfer bar operating means to either release the hammer at a single action let-off position, or to draw back the hammer and release it when the trigger is pulled to a double action let-off position.

BACKGROUND ART

A firearm, and in particular an autoloading or automatic firearm, is equipped with an external hammer that can be cocked to the rear and engaged with a sear and then tripped by squeezing the trigger which engages the sear by means of linkage releasing its engagement to the hammer (single action let-off). Alternatively, the hammer can be drawn to the rear for release and firing by squeezing the trigger without first cocking the hammer. This is accomplished through the linkage system engaging the hammer with the trigger for the aforementioned purpose; pulling the hammer rearward and releasing it before it can be engaged by the sear (double action let-off).

This invention relates to firearms functioning in the aforementioned manner incorporating a hammer spring, usually located in an area behind the magazine well in the frame and consisting of various components to accomplish the single action and double action let-offs. Historically, it is not recommended that anyone but an accomplished gunsmith work on these mechanisms as they are complicated and improper assembly or disassembly is very likely to occur. The invention addresses these issues by accomplishing the same objectives but with basic components that anyone with an aptitude for mechanics can easily understand.

Accordingly, one object of the present invention is to provide a simplified double action, hammer trigger mechanism for a firearm.

Another object of the invention is to provide an improved single action mechanism for releasing a sear engagement with a cocked hammer using a transfer bar connected to the trigger.

Another object of the invention is to provide an improved double action let-off mechanism using a transfer bar connected to the trigger for pulling back and releasing the hammer before the sear engages the hammer.

Still another object of the invention is to provide an improved hammer trigger mechanism suitable for an automatic or semi-automatic firearm of the type having a slide operated with a recoil spring for automatic or semi-automatic firing.

DISCLOSURE OF INVENTION

An improved double action, hammer trigger mechanism for a firearm of the type having a frame, a barrel for receiving a cartridge, a slide or bolt arranged to move longitudinally between a forward and a rearward position with respect to the barrel, the slide or bolt defining a cam surface, a firing pin longitudinally slidable in the slide or bolt so as to strike the cartridge, a hammer arranged to pivot about a first pivot point on the frame, the hammer defining a sear notch, spring biasing means urging the hammer toward the firing pin, a spring-loaded sear arranged to pivot about a second pivot point on the frame, the sear including a lip for cooperating with the sear notch to hold the hammer cocked when the hammer is pivoted, a trigger arranged to pivot about a third pivot point on the frame, the trigger having a trigger pivot pin thereon which is disposed so as to move in a forward direction when the trigger is pulled, a transfer bar having a first end connected to the trigger pivot pin, the transfer bar including a first finger cooperating with the cam surface when the slide is in a forward position, and a transfer spring biasing the first finger toward the cam surface, the improvement comprising a single action let-off pin disposed on the sear, the transfer bar further including a second finger arranged to engage the single action let-off pin and pivot the sear when the trigger is pulled so as to release the hammer when the sear is holding the hammer cocked, a double action let-off pin disposed on the hammer, the transfer bar defining a notch disposed to receive the double action let-off pin to cause the transfer bar to pivot the hammer in a cocking direction against the spring biasing means when the trigger is pulled to an intermediate position, the transfer bar first finger cooperating with the slide cam surface to move the transfer bar notch away from the let-off pin to release the hammer when the trigger is pulled to a double action let-off position.

BRIEF DESCRIPTION OF DRAWINGS

The invention will be better understood by reference to the following description, taken in connection with the accompanying drawings, in which.

BEST MODE FOR CARRYING OUT THE INVENTION

Figure 1:
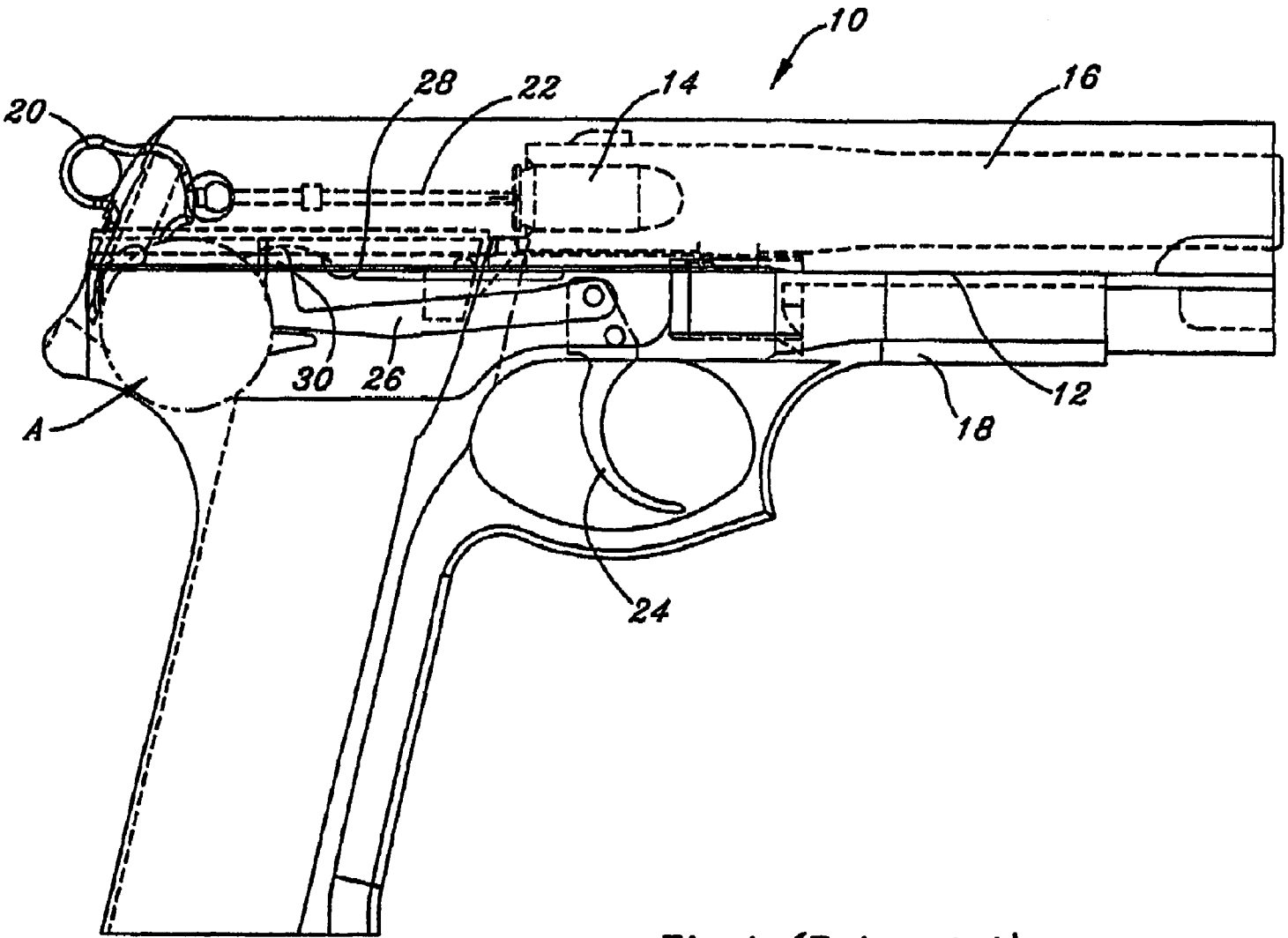
Fig. 1 (Prior Art)
FIG. 1 is a side elevational drawing, partly in section, of a semi-automatic firearm.

Referring now to FIG. 1 of the drawing, the invention is described as embodied in a semi-automatic firearm of the type using a spring-loaded cartridge magazine (not shown) and having a reciprocating slide 12 adapted to move from a forward position in a rearward direction against a recoil spring (not shown) when a cartridge 14 is fired. During the rearward movement, the shell of cartridge 14 is ejected, and during the return forward movement, a new cartridge is stripped from the magazine and inserted into the bore of a barrel 16 in a manner well known in the art. Slide 12 is reciprocable in tracks upon a frame 18. A hammer 20 is pivotably mounted on frame 18 to strike a firing pin 22, which is longitudinally slidable in the slide 12 so as to strike the rear of cartridge 14. A trigger 24 is pivotably mounted in the frame and connected to push or pull a transfer bar 26. Slide 12 includes a cam surface 28, which cooperates with a first finger 30 to raise or lower the end of transfer bar 26 when the transfer bar is pushed or pulled longitudinally by the trigger 24. The foregoing list of elements describes a construction known in the prior art. The invention relates to improvements in the linkages in the vicinity of arrow A, as illustrated in the following figures.

Figure 2A:
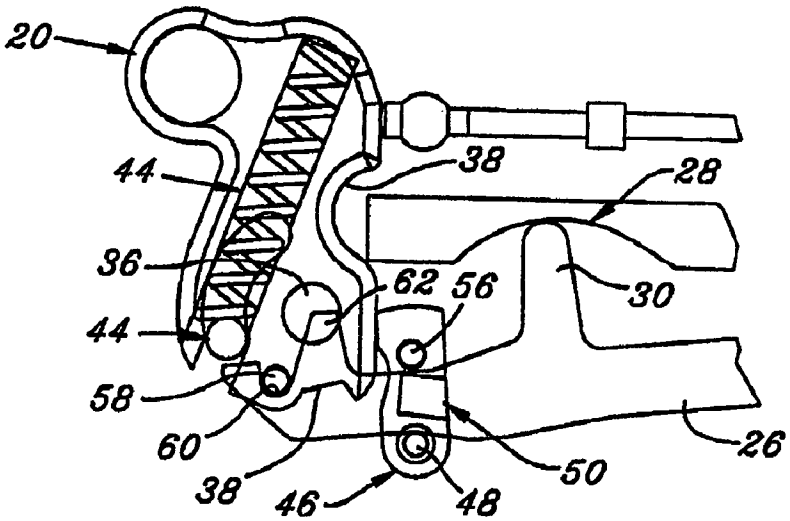
FIG. 2*a* is an enlarged view of a portion of the mechanism of FIG. 2.
Figure 2:
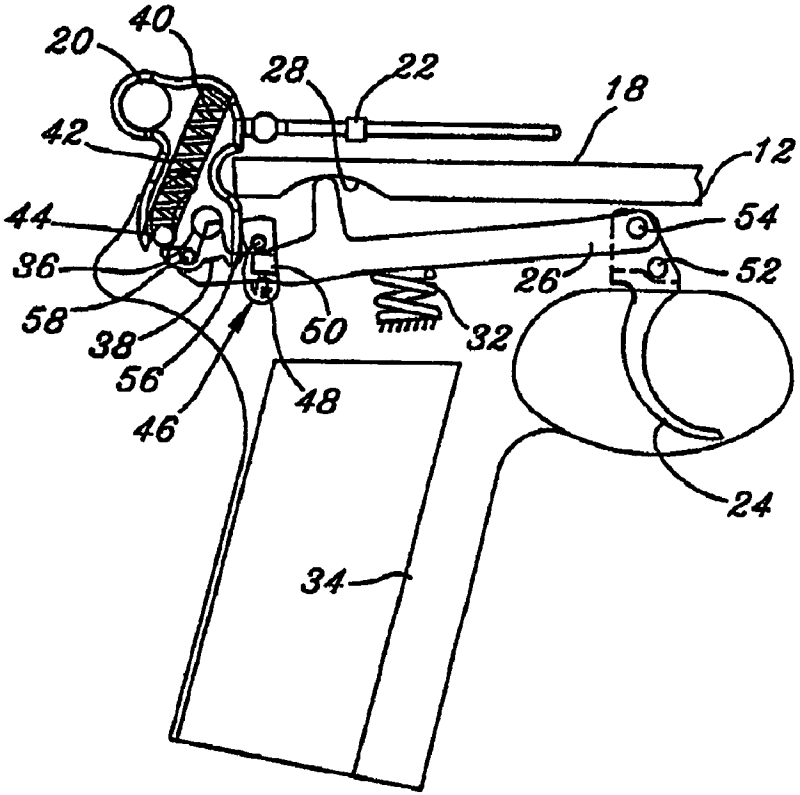
FIG. 2 is a stylized side elevational drawing of the uncocked hammer trigger mechanism.

Referring to FIG. 2 of the drawing, the hammer trigger mechanism is illustrated at 0° of trigger rotation and 0° of hammer rotation. Transfer bar 26 is biased upwardly by a transfer spring 32 of a suitable type located in a magazine well 34. Hammer 20 is arranged to pivot about a pin defining a first pivot point 36 on the frame. The hammer defines a sear notch 38 and is spring biased by a known type of spring biasing arrangement having a spring 40 compressed in a hammer spring well 42 by a hammer spring compression pin 44.

A spring-loaded sear 46 is arranged to pivot about a pin defining a second pivot point 48 against a compression spring located in a sear spring well 50. A spring-loaded sear is well known and the spring is not illustrated in order not to obscure the details of the invention.

The trigger 24 is arranged to pivot about a pin defining a third pivot point 52 on the frame, and is pivotably connected to transfer bar 26 by a trigger pivot pin 54. When the trigger 24 is pulled, the trigger pivot pin pulls the transfer bar 26 in a forward direction.

In accordance with the present invention, sear 46 is equipped with a single action let-off pin 56, and hammer 20 is equipped with a double action let-off pin 58. As shown in FIG. 2*a*, single action let-off pin 58 extends over the transfer bar 26 between first and second fingers 30 and 62 respectively, and double action let-off pin extends over the transfer bar 26 in alignment with notch 26.

Reference to the enlarged scale drawing of FIG. 2*a*, it is seen that the end of transfer bar 26 defines notch 60 disposed to receive the double action let-off pin 58. Further, the transfer bar 26 defines a second finger 62, which is arranged to engage the single action let-off pin and pivot the sear when the trigger is pulled.

Figure 3:
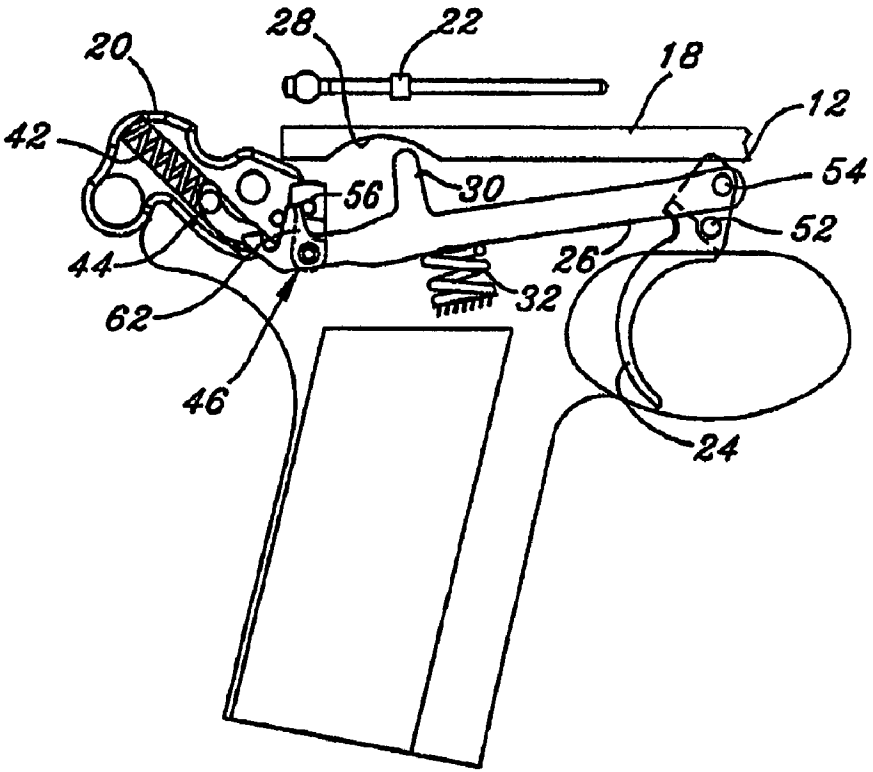
FIG. 3 is a side elevational drawing of the trigger mechanism according to FIG. 2, but with the hammer cocked for single action let-off.

Referring to FIG. 3 of the drawing, the hammer trigger mechanism is shown for 49.5° of trigger rotation and 60° of hammer rotation. Hammer 20 is shown cocked for single action let-off, and is being held in place by sear 46. Trigger 24 has been pulled, causing transfer bar 26 to be pulled forwardly and downwardly as dictated by the cam surface 28. The second finger 62 on the transfer bar is so positioned and dimensioned to engage the single action let-off pin 56. This causes sear 46 to pivot and release hammer 20 to strike firing pin 22.

Figure 4:
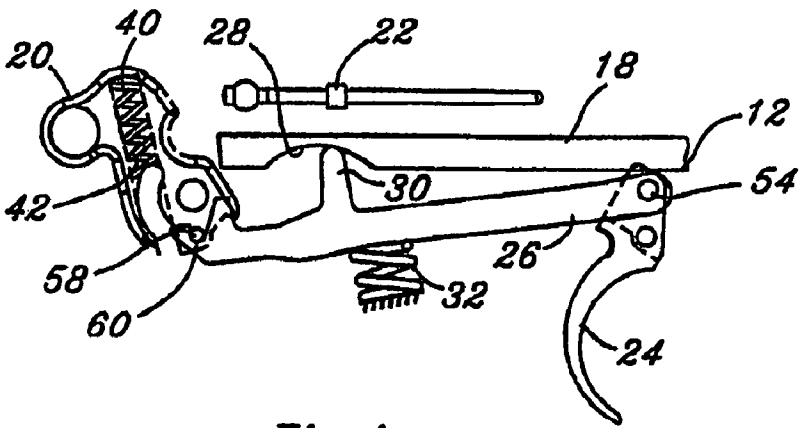
FIG. 4 is a simplified drawing of the major components of the trigger mechanism commencing double action hammer rotation.
Figure 6:
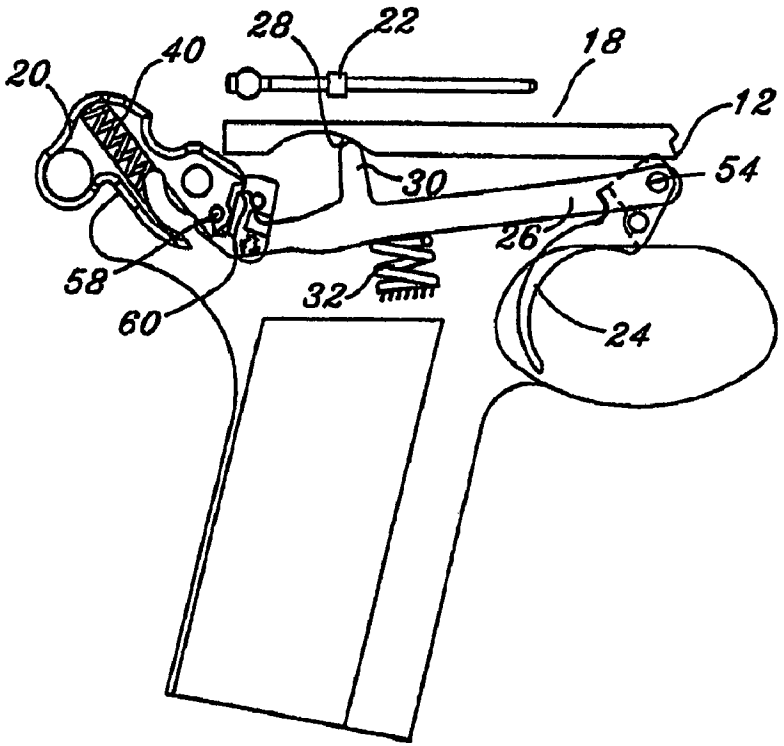
FIG. 6 is a side elevational view of the mechanism at the double action let-off position.
Figure 5:
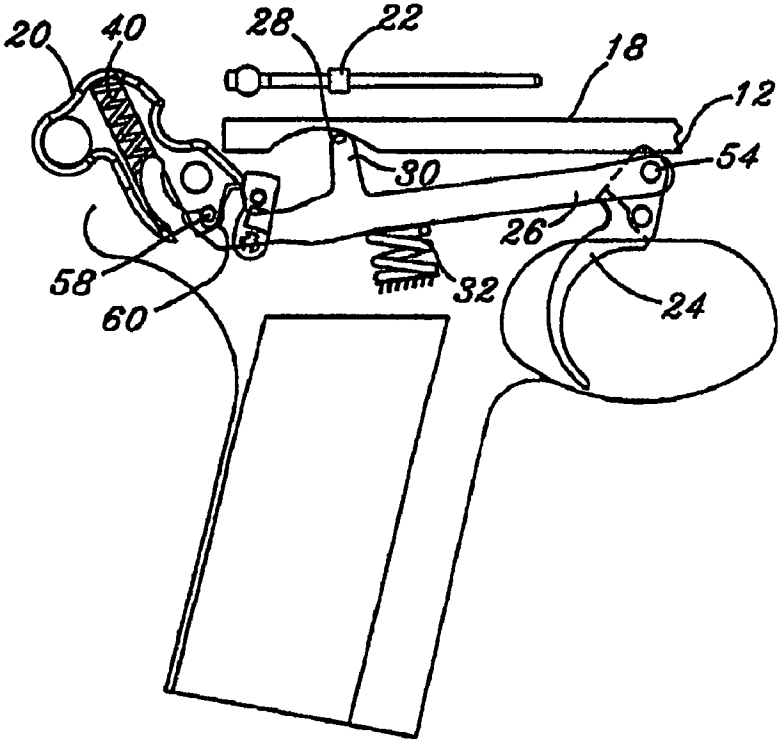
FIG. 5 is a side elevational drawing of the same mechanism at a later stage of double action movement.

FIGS. 4 through 6 illustrate the double action let-off sequence. Referring to FIG. 4 of the drawing, the hammer trigger mechanism is shown at 30° of trigger rotation and 34.2° of hammer rotation. As trigger 24 is pulled, the first finger 30 begins to force transfer bar 26 in a downward direction against transfer spring 32, as transfer bar 26 moves forward. The notch 60 in the transfer bar engages the double action let-off pin 58 and is starting to cock hammer 20 against the compression spring 40 in hammer spring well 42.

Referring to FIG. 5 of the drawing, trigger 24 has been drawn to a 40° rotation position to further rotate the hammer to a 35° position against spring 40. Cam surface 28 continues to cause the transfer bar 26 to move in a downward direction against transfer spring 32. This moves notch 60 in a direction away from the double action let-off pin 58.

Finally, referring to FIG. 6 of the drawing at double action let-off position, the trigger has been pulled to 55° trigger rotation, and the hammer to 49.2° hammer rotation. The sear has not yet engaged the hammer to hold it in a cocked position (FIG. 3). The first finger 30 has lowered transfer bar 26 to the point where notch 60 no longer holds the double action let-off pin 58. This releases hammer 20 to strike firing pin 22.

The invention has been described for a semi-automatic firearm with a recoil slide and the cam surface disposed in the slide when the slide is in the forward position. The invention is equally applicable to a firearm with a bolt instead of a slide mechanism. In this case, the bolt is closed to hold the cartridge in the chamber. When the bolt is at the forward position, a cam surface similar to cam surface 28 is so disposed in the bolt to cooperate with a transfer bar. The modification of the invention to apply to a firearm with a bolt will be readily understood by one skilled in the art.

While there has been described what is considered to be the preferred embodiment of the invention, other modifications will occur to those skilled in the art. It is desired to secure all such modifications as fall within the true spirit and scope of the invention.

The invention claimed is:

1. Improvement in a double action, hammer trigger mechanism for a firearm of a known type having a frame, a barrel for receiving a cartridge, a slide arranged to move longitudinally between a forward and a rearward position with respect to said barrel, said slide being spring-loaded in a forward direction and adapted to move in a rearward direction when the cartridge is fired, said slide defining a cam surface, a firing pin longitudinally slidable in the slide so as to strike the cartridge, a hammer arranged to pivot about a first pivot point on the frame, said hammer having a double action let-off pin disposed thereon and also defining a sear notch, spring biasing means urging said hammer toward the firing pin, a spring-loaded sear arranged to pivot about a second pivot point on the frame, said sear including a lip for cooperating with the sear notch to hold the hammer cocked when the hammer is pivoted against said spring biasing means, a trigger arranged to pivot about a third pivot point on the frame, said trigger having a trigger pivot pin thereon that is disposed so as to move in said forward direction when the trigger is pulled, a transfer bar having a first end connected to said trigger pivot pin, said transfer bar defining a transfer bar notch disposed to receive said double action let-off pin so as to enable said transfer bar to pivot the hammer in a cocking direction against said spring biasing means when the trigger is pulled, and a transfer spring biasing the first finger toward said cam surface, said improvement being characterized by:

a single action let-off pin disposed on said sear, said transfer bar including a first finger cooperating with said cam surface when the slide is in a forward position, said transfer bar further including a second finger arranged to engage said single action let-off pin and pivot the sear when the trigger is pulled so as to release the hammer when the sear is holding the hammer cocked, said transfer bar first finger being arranged to cooperate with the slide cam surface to move said transfer bar notch away from the double action let-off pin to release the hammer when the trigger is pulled further to a double action let-off position when the sear is not holding the hammer cocked.

2. The improvement according to claim 1, wherein said transfer bar has its first end pivotably mounted on said trigger pivot pin and extends in a rearward direction beneath said slide, and wherein said first finger extends laterally therefrom into engagement with said cam surface on the slide, said second finger being spaced from the first finger to receive said single action let-off pin therebetween and located to be proximate the single action let-off pin when the hammer is cocked.

3. The improvement according to claim 1, wherein said transfer bar has its first end pivotably mounted on said trigger pivot pin and extends in a rearward direction beneath said slide, and wherein said first finger extends laterally therefrom into engagement with said cam surface on the slide and said cam surface is contoured to pivot the transfer bar away from the slide as the trigger is pulled, said transfer bar notch being shaped to hold said double action let-off pin therein to move the hammer toward a cocked position as the trigger is pulled and to release the double action let-off pin therefrom before the hammer reaches the cocked position.

4. The improvement according to claim 1, wherein said transfer bar extends alongside said sear and wherein said single action let-off pin comprises a pin disposed on said sear and extending over the transfer bar between said first and second fingers.

5. The improvement according to claim 1, wherein said transfer bar extends alongside said hammer and wherein said double action let-off pin, comprises a pin disposed on said hammer and extending over the transfer bar in substantial alignment with said transfer bar notch.

* * * * *